US010805735B2

(12) United States Patent
Fujitani

(10) Patent No.: US 10,805,735 B2
(45) Date of Patent: Oct. 13, 2020

(54) DIAPHRAGM, SPEAKER UNIT USING SAME, HEADPHONE AND EARPHONE, AND DIAPHRAGM MANUFACTURING METHOD

(71) Applicant: Onkyo Corporation, Osaka (JP)

(72) Inventor: Takeshi Fujitani, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 16/294,302

(22) Filed: Mar. 6, 2019

(65) Prior Publication Data

US 2019/0289401 A1 Sep. 19, 2019

(30) Foreign Application Priority Data

Mar. 15, 2018 (JP) ..... 2018-048163

(51) Int. Cl.

| | |
|---|---|
| ***H04R 9/06*** | (2006.01) |
| ***H04R 1/10*** | (2006.01) |
| ***H04R 31/00*** | (2006.01) |
| ***H04R 7/18*** | (2006.01) |
| ***H04R 9/02*** | (2006.01) |

(Continued)

(52) U.S. Cl.

CPC ..... *H04R 9/06* (2013.01); *H04R 1/10* (2013.01); *H04R 7/127* (2013.01); *H04R 7/18* (2013.01); *H04R 9/025* (2013.01); *H04R 31/003* (2013.01); *H04R 1/20* (2013.01); *H04R 7/12* (2013.01); *H04R 7/14* (2013.01); *H04R 9/04* (2013.01); *H04R 25/00* (2013.01)

(58) Field of Classification Search

CPC ... H04R 1/20; H04R 9/06; H04R 9/04; H04R 25/00; H04R 7/14; H04R 1/10; H04R 7/127; H04R 7/18; H04R 9/025; H04R 7/12

See application file for complete search history.

(56) References Cited

U.S. PATENT DOCUMENTS 6,266,733 B1 * 7/2001 Knittel ..... G06T 1/60 345/424

9,473,840 B2 10/2016 Akino (Continued)

FOREIGN PATENT DOCUMENTS

JP 57-200996 U1 12/1982

JP 62-139191 U1 9/1987

(Continued)

*Primary Examiner* — Davetta W Goins

*Assistant Examiner* — Kuassi A Ganmavo

(57) ABSTRACT

An edge portion of a diaphragm is configured such that multiple recessed ribs formed by recessing of a raised surface are provided in an inclination direction inclined with respect to a radial line passing through a center point and are arranged rotationally symmetrically, and among the recessed ribs and a fixing portion defined on the outermost peripheral side of the diaphragm, defines an outer peripheral edge portion at which no recessed ribs are formed. A voice coil is coupled to a voice coil attachment portion. A lead line is fixed with a first adhesive forming a first adhesive layer along a valley portion defined between a certain recessed rib and an adjacent recessed rib thereof on a back side of the edge portion, and is further fixed with a second adhesive forming a second adhesive layer with the lead line being curved along the outer peripheral edge portion.

7 Claims, 7 Drawing Sheets

(51) Int. Cl.

| | |
|---|---|
| ***H04R 7/12*** | (2006.01) |
| ***H04R 25/00*** | (2006.01) |
| ***H04R 7/14*** | (2006.01) |
| ***H04R 9/04*** | (2006.01) |
| ***H04R 1/20*** | (2006.01) |

(56) References Cited

U.S. PATENT DOCUMENTS

2004/0007420 A1* 1/2004 Takahashi ..... H04R 7/20 181/171
2006/0008111 A1* 1/2006 Nagaoka ..... H04R 31/003 381/423
2006/0070796 A1* 4/2006 Frasl ..... H04R 7/14 181/173
2007/0209866 A1* 9/2007 Frasl ..... H04R 7/18 181/157
2007/0274543 A1* 11/2007 Ueda ..... H04R 7/12 381/162
2009/0028376 A1* 1/2009 Saito ..... H04R 7/12 381/423
2009/0060251 A1* 3/2009 Maeda ..... H04R 7/02 381/398
2011/0031061 A1* 2/2011 Wildhagen ..... H04R 7/122 181/173
2011/0110554 A1* 5/2011 Qiao ..... H04R 5/023 381/412
2011/0317869 A1* 12/2011 Fujitani ..... H04R 7/12 381/423
2013/0070953 A1* 3/2013 Dodd ..... B26B 21/528 381/398
2013/0182885 A1* 7/2013 Fujitani ..... H04R 3/00 381/412
2015/0124992 A1* 5/2015 Akino ..... H04R 1/06 381/74
2016/0330549 A1* 11/2016 Yuen ..... H04R 7/125

FOREIGN PATENT DOCUMENTS

| | | | | |
|---|---|---|---|---|
| JP | 05-001195 | Y | | 1/1993 |
| JP | H08140183 | A | * | 5/1996 |
| JP | H09135491 | A | * | 5/1997 |
| JP | 2004-129080 | A | | 4/2004 |
| JP | 6242160 | B | | 12/2017 |
| KR | 840001170 | Y1 | * | 6/1984 |
| KR | 200436268 | Y1 | * | 7/2007 |

* cited by examiner

DIAPHRAGM, SPEAKER UNIT USING SAME, HEADPHONE AND EARPHONE, AND DIAPHRAGM MANUFACTURING METHOD

BACKGROUND OF THE INVENTION

1. Field of the Invention

The present invention relates to a diaphragm of an electrodynamic speaker unit used for a headphone or an earphone attached to an ear of a user to reproduce audio.

2. Description of the Related Art

In a compact electrodynamic speaker unit used for a headphone or an earphone, a diaphragm is used in some cases, the diaphragm being formed from a film-shaped member formed using a resin material such as polyethylene terephthalate (PET) or polyetherimide (PEI) and being configured such that a dome portion and an edge portion extending at the outer periphery of the dome portion are integrated. In this electrodynamic speaker, a voice coil configured to supply audio signal current is, from a back side, attached to a joint portion between the center dome portion and the edge portion integrally formed in the diaphragm. An outer peripheral end side of the edge portion of the diaphragm is fixed to a frame coupled to a compact lightweight magnetic circuit, and a coil of the voice coil is arranged in a magnetic gap of the magnetic circuit.

The shape of the diaphragm provides influence on quality and sound pressure frequency characteristics of audio reproduced by the electrodynamic speaker unit. Specifically, in the diaphragm configured such that the dome portion and the edge portion are integrally formed, multiple ribs (protrusions or grooves) are, in many cases, provided at the raised (roll shaped) edge portion to adjust vibration characteristics of the vertically-vibrating and deforming edge portion. For example, JP-UM-A-57-200996 discloses a speaker diaphragm configured such that multiple ribs are formed between an inner peripheral edge and an outer peripheral edge at equal intervals along a curved line in non-contact with the inner peripheral edge. Moreover, JP-UM-A-62-139191 discloses that in an acoustic reproduction diaphragm having a roll-shaped edge, multiple arc-shaped grooves and protrusions passing through the total of three points including intersections A, B between a tangent to an edge inner circumference and an edge inner/outer circumference and a point C equally separated from the intersections A, B on a circumference in the half of a distance between the edge inner and outer circumferences are provided not to overlap with each other across an entire curved surface.

An edge portion having the multiple ribs in a diagonal direction as in Fig. 1 or 2 of JP-UM-A-57-200996 is sometimes referred to as a "tangential edge." In a section of such a rib as illustrated in Fig. 2 or 4 of JP-UM-A-57-200996, a base is bent such that a corner is provided linearly. The edge portion of the diaphragm is bent at a sharp angle at the rib. Moreover, as also described in JP-UM-A-62-139191, when the diaphragm vibrates vertically, if mobility of the edge portion is different between an upward direction and a downward direction, i.e., displacement symmetry of the edge portion varies, and therefore linearity of the diaphragm is degraded, failure such as rolling of the diaphragm or occurrence of noise is easily caused. With a difference in the displacement symmetry of the edge portion, there is a problem that the probability of increasing even-order distortion of a sound wave emitted from the electrodynamic speaker unit is increased and reproduced sound quality is degraded.

In the electrodynamic speaker unit using the diaphragm as described above, the voice coil is attached to the diaphragm, and therefore, shaping processing for a lead line configured to supply audio signal current to the voice coil becomes a challenge. The shaping processing for the lead line may include processing using aerial wiring not fixing the lead line to the diaphragm for the purpose of reducing a vibration system weight, but failure such as disconnection or a jumping-rope phenomenon is easily caused. For this reason, in the diaphragm of the compact electrodynamic speaker unit used for the headphone or the earphone, the lead line of the voice coil is often fixed with an adhesive along the edge portion, and is drawn to an outer peripheral side terminal of the frame.

However, an extremely-thin film material is used for the diaphragm, and a certain extent of contraction is accompanied by curing of the adhesive for fixing the lead line of the voice coil. For this reason, there is a difference in strength and stiffness between a portion where the adhesive for fixing the lead line of the voice coil is applied and cured and a portion where no adhesive is applied, leading to a problem that deformation of the diaphragm is easily caused. Moreover, the electrodynamic speaker unit using the diaphragm has a problem that rolling of the diaphragm is easily caused and vertical symmetry is easily degraded. For these reasons, a measure has been typically taken for the shaping processing for the lead line of the voice coil.

For example, JP-UM-B-5-1195 discloses a dome-shaped speaker having a vibration system structure in which the total of three groove-shaped corrugations A2a are, together with a normal corrugation B2b, formed along a tangent to a dome-shaped diaphragm 1 at positions separated from each other by 120 degrees at an edge 2 supporting the diaphragm 1 at the outer periphery thereof, a lead line 3a of a voice coil 3 is drawn with the lead line 3a being bonded along the inside of one corrugation A of the corrugations A3a, and only an adhesive is applied to the inside of the remaining two corrugations A. The corrugation A2a may be in a shape along a curved line circumscribing the outer periphery of the diaphragm 1 and inscribing the outer periphery of the edge 2.

JP-A-2004-129080 discloses a speaker unit configured such that in a frame, a vibratable diaphragm of which outer peripheral edge is a fixed end, a voice coil fixed to a center portion of the diaphragm, and a magnet causing a magnetic field to act on the voice coil are arranged and configured to vibrate the diaphragm by power distribution to the voice coil. In the speaker unit, multiple ribs extending to bend in a spiral shape from a voice coil side to the outer peripheral edge are formed at an outer peripheral portion of the diaphragm on the outside of the voice coil. A lead line drawn from the voice coil extends on a bent line along one rib, and a tip end portion of the lead line protrudes from the diaphragm and is connected to a terminal provided at the frame.

Japanese Patent No. 6242160 discloses a dynamic headphone unit having a diaphragm having a sub-dome forming an outer peripheral portion and fixed to a voice coil, a permanent magnet, a pole piece provided on one polarity side of the permanent magnet, and a yoke provided on the other polarity side of the permanent magnet and configured such that the voice coil is vibratably supported via the diaphragm in a magnetic gap formed between the pole piece and the yoke. A lead wire in which signal current flows is provided at the voice coil. Multiple linear corrugations are formed with spacing in a radial direction at the sub-dome. The lead wire is, with a pressure sensitive adhesive, linearly bonded to an inner surface side of the sub-dome between the corrugations.

The present invention has been made for solving the above-described problems of the typical techniques. An object of the present invention relates to a diaphragm including a voice coil of an electrodynamic speaker unit used for a headphone or an earphone, and specifically is to provide a headphone and a speaker unit configured so that displacement symmetry can be improved regarding shaping processing for a lead line of a voice coil in a diaphragm configured such that a dome portion and an edge portion are integrated, failure such as rolling of the diaphragm or occurrence of noise can be prevented, and excellent reproduced sound quality can be provided.

SUMMARY OF THE INVENTION

The diaphragm of the present invention is a diaphragm including a voice coil forming an electrodynamic speaker unit used for a headphone or an earphone. The diaphragm is formed from a sheet-shaped member or a film-shaped member such that a center dome portion and an edge portion extending at the outer periphery of the dome portion and having a raised section in a radial direction are integrated. The edge portion is configured such that multiple recessed ribs formed by recessing of a raised surface are provided in an inclination direction inclined with respect to a radial line passing through a center point and are arranged rotationally symmetrically, and among the recessed ribs and a fixing portion defined on the outermost peripheral side of the diaphragm, defines an outer peripheral edge portion at which no recessed ribs are formed. The voice coil is coupled to a voice coil attachment portion defined at an outer peripheral portion of the dome portion. A lead line configured to supply signal current to the voice coil is fixed with a first adhesive forming a first adhesive layer along a valley portion defined between one of the recessed ribs and an adjacent one of the recessed ribs on a back side of the edge portion, and is further fixed with a second adhesive forming a second adhesive layer with the lead line being curved along the outer peripheral edge portion.

Preferably, in the diaphragm of the present invention, the second adhesive layer is formed by curing of the applied second adhesive at least after the first adhesive layer has been formed by curing of the first adhesive.

Preferably, in the diaphragm of the present invention, an end portion of the first adhesive layer reaching the outer peripheral edge portion is covered with the second adhesive layer.

Preferably, in the diaphragm of the present invention, the first adhesive and the second adhesive are both ultraviolet cure adhesives.

A speaker unit of the present invention includes the above-described diaphragm, a frame fixed to the fixing portion of the edge portion of the diaphragm, a terminal fixed to the frame and connected to the lead line of the voice coil, a magnetic circuit having a magnetic gap in which a coil of the voice coil is arranged and fixed to the frame, and a damping member attached to cover an opening of the frame.

A headphone or an earphone of the present invention includes the above-described speaker unit.

A diaphragm manufacturing method of the present invention is the method for manufacturing a diaphragm including a voice coil forming an electrodynamic speaker unit used for a headphone or an earphone. The method includes the step of integrally forming, from a sheet-shaped member or a film-shaped member, a center dome portion of the diaphragm and an edge portion extending at the outer periphery of the dome portion and having a raised section in a radial direction, providing, at the edge portion, multiple recessed ribs formed by recessing of a raised surface in an inclination direction inclined with respect to a radial line passing through a center point and rotationally symmetrically arranging the recessed ribs, and defining, among the recessed ribs and a fixing portion defined on the outermost peripheral side of the diaphragm, an outer peripheral edge portion at which no recessed ribs are formed; the step of coupling the voice coil to a voice coil attachment portion defined at an outer peripheral portion of the dome portion; the step of fixing a lead line configured to supply signal current to the voice coil with a first adhesive forming a first adhesive layer along a valley portion defined between one of the recessed ribs and an adjacent one of the recessed ribs on a back side of the edge portion; and the step of further fixing the lead line with a second adhesive forming a second adhesive layer with the lead line being curved along the outer peripheral edge portion.

Hereinafter, features of the present invention will be described.

The diaphragm of the present invention is the diaphragm including the voice coil forming the electrodynamic speaker unit used for the headphone or the earphone. The diaphragm is formed from the sheet-shaped member or the film-shaped member such that the center dome portion and the edge portion extending at the outer periphery of the dome portion and having the raised section in the radial direction are integrated. The edge portion is configured such that the multiple recessed ribs formed by recessing of the raised surface are provided in the inclination direction inclined with respect to the radial line passing through the center point and are arranged rotationally symmetrically, and among the recessed ribs and the fixing portion defined on the outermost peripheral side of the diaphragm, defines the outer peripheral edge portion at which no recessed ribs are formed.

The speaker unit may include the diaphragm, the frame fixed to the fixing portion of the edge portion of the diaphragm, the terminal fixed to the frame and connected to the lead line of the voice coil, the magnetic circuit having the magnetic gap in which the coil of the voice coil is arranged and fixed to the frame, and the damping member attached to cover the opening of the frame. The speaker unit can form the headphone or the earphone of the present invention.

In the diaphragm of the present invention, the voice coil is coupled to the voice coil attachment portion defined at the outer peripheral portion of the dome portion. The lead line configured to supply the signal current to the voice coil is fixed with the first adhesive forming the first adhesive layer along the valley portion defined between one of the recessed ribs and the adjacent one of the recessed ribs on the back side of the edge portion, and is further fixed with the second adhesive forming the second adhesive layer with the lead line being curved along the outer peripheral edge portion.

Thus, regarding shaping processing for the lead line of the voice coil, the first adhesive for fixing the lead line forms the first adhesive layer not reaching three or more recessed ribs, and the second adhesive for further fixing the lead line is applied to the outer peripheral edge portion of the diaphragm on the outermost peripheral side to form the second adhesive layer. Thus, a difference in strength and stiffness of the diaphragm in a circumferential direction is less caused. As a result, the electrodynamic speaker unit using the diaphragm can improve vertical displacement symmetry and linearity of the edge portion of the diaphragm, can reduce rolling of the diaphragm or occurrence of noise, and can provide excellent reproduced sound quality.

In the diaphragm, the second adhesive layer is preferably formed by curing of the applied second adhesive at least after the first adhesive layer has been formed by curing of the first adhesive. The lead line of the voice coil can be first shaped and fixed along the valley portion defined between two recessed ribs, and can be further shaped and fixed with the lead line being curved along the outer peripheral edge portion. The end portion of the first adhesive layer reaching the outer peripheral edge portion may be covered with the second adhesive layer. The diaphragm manufacturing method of the present invention can be implemented when the first adhesive and the second adhesive are both the ultraviolet cure adhesives.

The headphone and the speaker unit can be provided, which in the diaphragm of the electrodynamic speaker unit used for the headphone or the earphone according to the present invention, specifically the diaphragm configured such that the dome portion and the edge portion are integrally formed, improve the displacement symmetry and the linearity regarding the shaping processing for the lead line of the voice coil, prevent failure such as rolling of the diaphragm or occurrence of noise, and provide excellent reproduced sound quality.

DETAILED DESCRIPTION OF THE PREFERRED EMBODIMENTS

Hereinafter, a diaphragm, a speaker unit using this diaphragm, a headphone, and an earphone according to preferred embodiments of the present invention will be described, but the present invention is not limited to these embodiments.

First Embodiment

Figure 1:
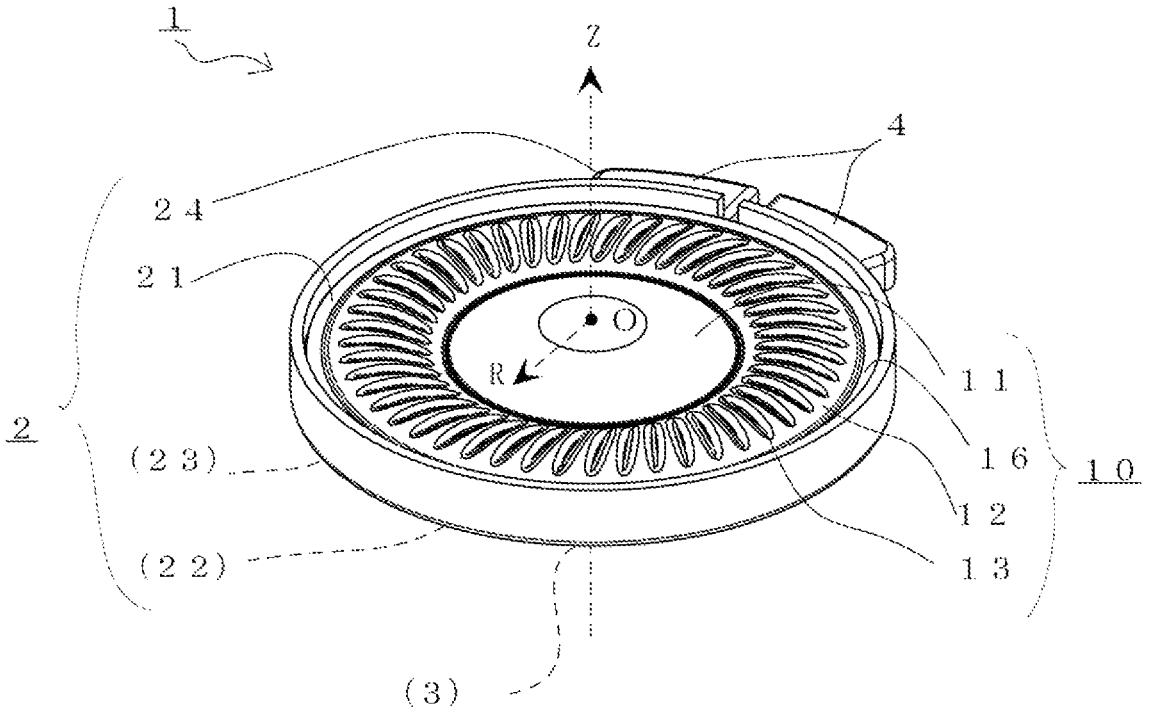
FIG. 1 is a view of an outer appearance of an electrodynamic speaker unit used for a headphone or an earphone according to one embodiment of the present invention.
Figure 2:
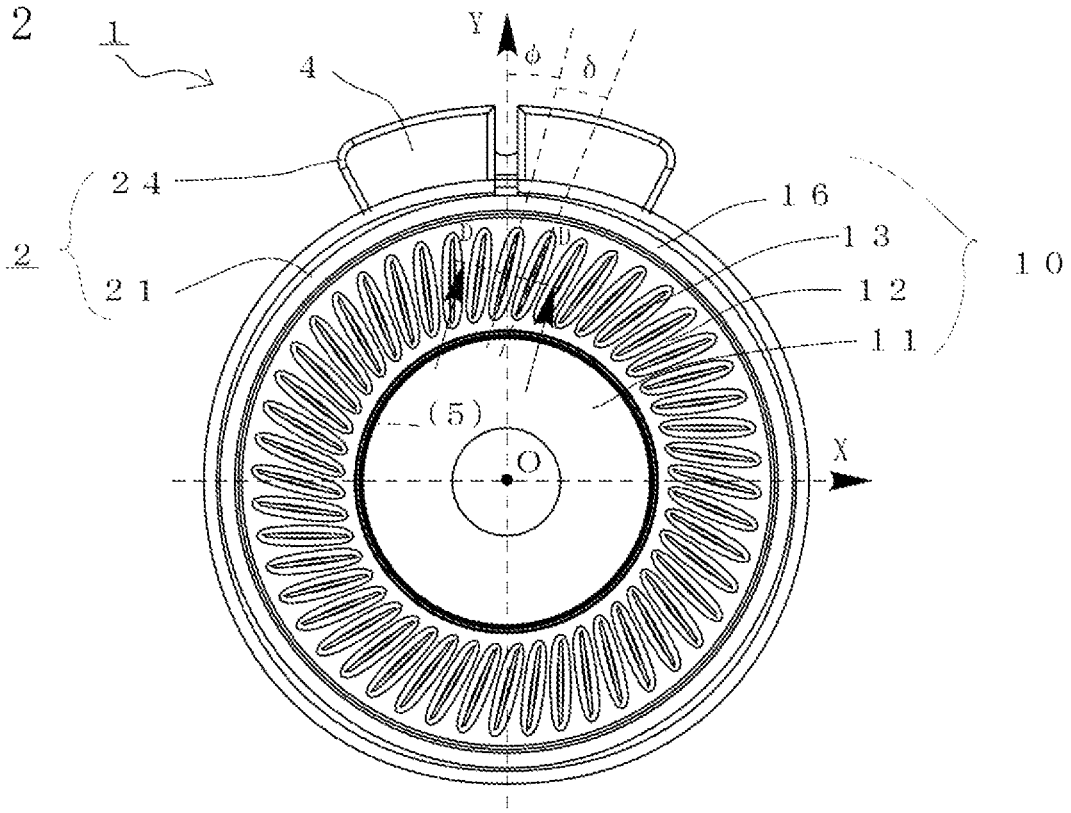
FIG. 2 is a view for describing a specific structure of the speaker unit according to one embodiment of the present invention.

FIGS. 1 and 2 are views for describing an electrodynamic speaker unit 1 used for a headphone or an earphone according to a preferred embodiment of the present invention. Specifically, FIG. 1 is a perspective view of an outer appearance of the speaker unit 1 from a front side, and FIG. 2 is a view of the speaker unit 1 from the front side. Note that the form of the speaker unit 1 is not limited to that in the case of the present embodiment. Moreover, a configuration of the speaker unit 1 unnecessary for description of the present invention will not be shown in the figures, and will not be described.

The speaker unit 1 of the present embodiment is an electrodynamic speaker used for the headphone or the earphone arranged in the vicinity of an ear of a user and having a small nominal diameter of 40 mm. Note that the speaker unit 1 is attached to a cavity of the headphone or a body of the earphone to form the headphone or the earphone. Note that a specific form of the headphone or the earphone using the speaker unit 1 will not be shown in the figures and will not be described.

The speaker unit 1 includes a frame 2 made of a resin material, a (not-shown) magnetic circuit 3 fixed to the frame 2, a diaphragm 10 formed from a film-shaped polyethylene terephthalate (PET) member, a (not-shown) voice coil 5 coupled to the diaphragm 10 and configured such that a coil thereof is arranged in a (not-shown) magnetic gap of the (not-shown) magnetic circuit 3, a terminal 4 connected to a (not-shown) lead line 6 from the coil of the voice coil 5, and a (not-shown) damping member attached to the frame 2 and configured such that a sound wave emitted from the diaphragm 10 passes through the damping member. Note that the damping member covering the magnetic circuit 3, the voice coil 5, and later-described openings of the frame 2 is positioned on a back side of the diaphragm 10 and is hidden in FIGS. 1 and 2. Thus, an outer appearance of the damping member is not shown.

The diaphragm 10 is an integrated diaphragm of a dome portion 11 such as part of a spherical surface and an edge portion 12 extending at the outer periphery of the dome portion 11. The voice coil 5 to which audio signal current is supplied from the back side is attached to a portion joined to the edge portion 12 at an outer peripheral portion of the dome portion 11. An outer peripheral end side fixing portion 16 of the edge portion 12 of the diaphragm 10 is fixed to a diaphragm fixing portion 21 of the frame 2, and the compact lightweight magnetic circuit 3 is fixed to a (not-shown) magnetic circuit fixing portion 22 of the frame 2. The openings communicating with the magnetic gap of the magnetic circuit 3 and configured such that the voice coil 5 passes through the openings are provided inside the magnetic circuit fixing portion 22. The coil of the voice coil 5 coupled to the diaphragm 10 is arranged in the magnetic gap of the magnetic circuit 3.

Thus, in the speaker unit 1, when the audio signal current is supplied to the voice coil 5 arranged in the magnetic gap of the magnetic circuit 3 generating a strong DC field, drive force is generated in an illustrated Z-axis direction, and therefore, a speaker vibration system including the voice coil 5 and the diaphragm 10 vibrates in the Z-axis direction. That is, the speaker vibration system is vibratably supported only by the edge portion 12 of the diaphragm 10. As a result, a pressure change is caused in air around the diaphragm 10, and the audio signal current is converted into a sound wave (audio).

The frame 2 has the substantially circular ring-shaped diaphragm fixing portion 21 for fixing the fixing portion 16 of the edge portion 12 of the diaphragm 10, the substantially circular ring-shaped magnetic circuit fixing portion 22 for fixing the magnetic circuit 3, a (not-shown) coupling portion 23 configured to couple the diaphragm fixing portion 21 and the magnetic circuit fixing portion 22 to define the multiple (not-shown) openings, and a terminal fixing portion 24 provided to protrude to an outer peripheral side of the diaphragm fixing portion 21 for fixing the terminal 4. The frame 2 is attached such that the dome portion 11 and the edge portion 12 of the diaphragm 10 are exposed on the front side, and is configured such that a sound wave emitted from the front side of the diaphragm 10 is reproduced.

Further, regarding a sound wave being in a reversed phase relationship with the sound wave emitted from the front side of the diaphragm 10 and emitted from the back side of the diaphragm 10, the frame 2 is configured such that a sound wave from the edge portion 12 is reproduced to the back side through the multiple (not-shown) openings defined at the coupling portion 23. The (not-shown) damping member covering the openings and exhibiting air permeability can be attached to the coupling portion 23. The speaker unit 1 can adjust compliance (an acoustic capacity) of an internal space of the frame 2 by the openings and the damping member according to the headphone or the earphone, and can adjust frequency characteristics, specifically low frequency characteristics, by adjustment of the compliance. The terminal fixing portion 24 protruding to the outer peripheral side of the diaphragm fixing portion 21 to fix the terminal 4 is provided at the frame 2, and therefore, the openings can be uniformly provided across a circumferential direction at the coupling portion 23 of the frame 2.

The frame 2 of the present embodiment employs the resin material. Thus, the lightweight frame 2 having favorable balance among a high internal loss and excellent mechanical characteristics, excellent heat resistance, and an excellent S/N ratio can be obtained. More specifically, polyphenylene ether-based resin, polystyrene-based resin, and polyolefin-based resin are contained at a specific ratio. Thus, the frame 2 having favorable balance among a significantly-high internal loss and excellent mechanical characteristics and exhibiting excellent vibration characteristics without degrading excellent heat resistance, humidity resistance, formability, dimension stability, and lightness originally possessed by these types of resin can be obtained.

The diaphragm 10 is formed from the film-shaped polyethylene terephthalate (PET) member having a thickness of 20 μm. The edge portion 12 of the diaphragm 10 is such a roll edge that a section in a radial direction is in a raised shape, and as illustrated in FIGS. 1 and 2, multiple recessed ribs 13 formed by recessing of the raised surface are provided. Moreover, FIG. 3 is a partially-enlarged view of a D-D section of FIG. 2, and is a view for describing the recessed ribs 13 of the edge portion 12 of the diaphragm 10 and a valley portion 14 defined between a certain recessed rib 13 and an adjacent recessed rib 13 thereof on the back side of the edge portion 12.

The recessed rib 13 is provided in an inclination direction inclined at an angle φ (=15 degrees) with respect to a radial line R passing through a center point O. At the edge portion 12, 48 recessed ribs 13 of the present embodiment are rotationally symmetrically arranged at an interval of an angle δ (=7.5 degrees) about the center point O. The recessed ribs 13 improve displacement symmetry of the diaphragm 10, prevent failure such as rolling of the diaphragm 10 or occurrence of noise, and improve reproduced sound quality.

Figure 3:
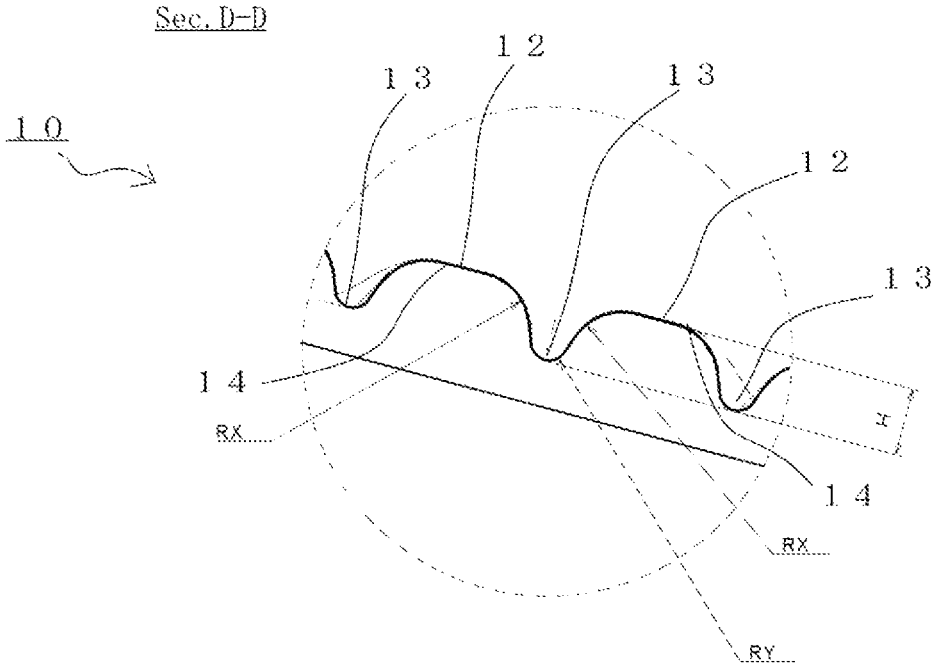
FIG. 3 is a sectional view of the shape of a diaphragm according to one embodiment of the present invention.

The sectional view of FIG. 3 illustrates sections of the recessed ribs 13 formed by recessing of the raised surface of the edge portion 12. In FIG. 3, the sections of the recessed ribs 13 are shown at three spots including one spot between two raised surfaces of the edge portion 12 and two spots on both end sides of these raised surfaces. For example, the depth H of the center recessed rib 13 from the raised surface of the edge portion 12 is different between the position of the D-D section and a position close to an inner or outer peripheral end portion of the edge portion 12, and is greatest in the vicinity of the position of the D-D section. The recessed ribs 13 are provided as long deep groove-shaped portions at other portions of the raised edge portion 12 than both end portions thereof. An inner end of each recessed rib 13 does not reach the portion joined to the edge portion 12 at the outer peripheral portion of the dome portion 11, and an outer end of each recessed rib 13 does not reach the fixing portion fixed to the diaphragm fixing portion 21 of the frame 2.

Each recessed rib 13 is formed such that a ridge line portion defining a boundary between the recessed rib 13 and the raised surface of the edge portion 12 is chamfered with a small curved surface from an inner peripheral side to the outer peripheral side. In the sectional view of FIG. 3, the curved surface formed by chamfering of the ridge line portion of the recessed rib 13 is indicated by a dimension Rx indicating a sectional radius. The radius diameter Rx may be, for example, set to a predetermined value of equal to or greater than 0.3 mm and equal to or less than 1.0 mm. Moreover, a bottom portion of each recessed rib 13 is chamfered with a small curved surface in a degree similar to that of the curved surface of the ridge line portion. In the sectional view of FIG. 3, the curved surface formed by chamfering of the bottom portion of the recessed rib 13 is indicated by a dimension Ry indicating a sectional radius.

On the other hand, on the back side of the edge portion 12, the valley portion 14 is defined between the certain recessed rib 13 and the adjacent recessed rib 13 thereof. The valley portion 14 is on the back side of the raised surface of the edge portion 12. The depth H of the recessed rib 13 from the raised surface of the edge portion 12 also defines the depth dimension of the valley portion 14. Thus, an inner end of the valley portion 14 as viewed from the back side of the edge portion 12 does not reach the portion joined to the edge portion 12 at the outer peripheral portion of the dome portion 11, and an outer end of the valley portion 14 does not reach the fixing portion 16 fixed to the diaphragm fixing portion 21 of the frame 2. As a result, on the back side of the edge portion 12, a circular ring-shaped outer peripheral edge portion 15 at which the recessed ribs 13 and the valley portions 14 are not formed is defined among the outer ends of the recessed ribs 13 and the valley portions 14 and the fixing portion 16.

Figure 4B:
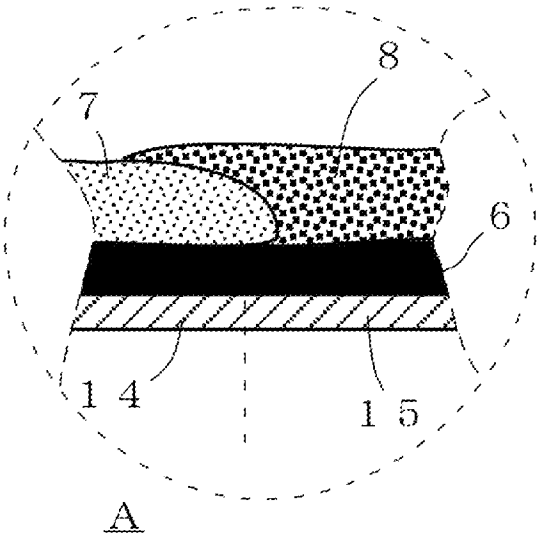
FIGS. 4A and 4B are views for describing shaping processing for a lead line of a voice coil at the diaphragm according to one embodiment of the present invention.
Figure 4A:
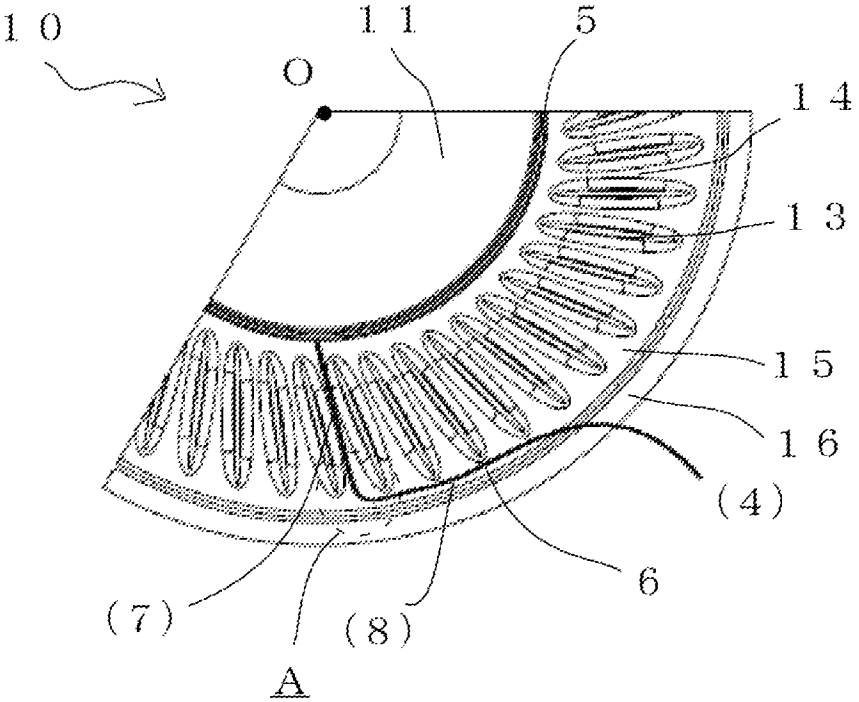

FIGS. 4A and 4B are views for describing shaping processing for the lead line 6 of the voice coil 5 at the diaphragm 10 of the present embodiment. Specifically, FIG. 4A is a view for describing a state in which part of the diaphragm 10 coupled to the voice coil 5 is viewed from the back side, and FIG. 4B is an enlarged sectional view of a portion A of FIG. 4B. The lead line 6 of the voice coil 5 is fixed with a first adhesive and a second adhesive along the back side of the edge portion 12 of the diaphragm 10. Note that description of the shaping processing for the lead line 6 is prioritized, and a first adhesive layer 7 formed by curing of the first adhesive and a second adhesive layer 8 formed by curing of the second adhesive are not shown in FIG. 4A.

On the back side of the diaphragm 10, the circular ring-shaped voice coil 5 is coupled to a voice coil attachment portion defined at the outer peripheral portion of the dome portion 11. Then, the lead line 6 connected to the voice coil 5 to supply the signal current is drawn to the outer peripheral side along the back side of the edge portion 12. Upon assembly as the speaker unit 1, a terminal end of the lead line 6 is connected to the terminal 4 not shown in FIG. 4A. Note that at least two lead lines 6 of the voice coil 5 each connected to both ends of the coil wound in a circular ring shape are necessary, but the same shaping processing is employed for these lead lines 6. Thus, the shaping processing for only one of these lead lines 6 will be described below.

On the back side of the edge portion 12 of the diaphragm 10, the lead line 6 of the voice coil 5 is first arranged to extend toward the outer peripheral side along the valley portion 14 defined between the certain recessed rib 13 and the adjacent recessed rib 13 thereof, and is directly fixed with the first adhesive. The first adhesive is an ultraviolet cure adhesive curable by irradiation with ultraviolet light. The first adhesive forms the first adhesive layer 7 exhibiting elasticity even after having cured, and fixes the lead line 6 to the valley portion 14 with the lead line 6 being included in the first adhesive layer 7. Thus, an outer peripheral end portion of the first adhesive layer 7 substantially reaches the outer peripheral edge portion 15 of the diaphragm 10. The portion A of FIG. 4A illustrated in closeup in the sectional view of FIG. 4B is a portion including the outer peripheral end portion of the first adhesive layer 7.

Subsequently, the lead line 6 of the voice coil 5 is arranged with the lead line 6 being curved at the portion A along the outer peripheral edge portion 15 of the diaphragm 10, and is directly fixed with the second adhesive. As described above, the lead line 6 has been fixed with the first adhesive along the valley portion 14. Thus, the lead line 6 can be curved and shaped along the outer peripheral edge portion 15, and can be fixed with the second adhesive. The second adhesive is, as in the first adhesive, an ultraviolet cure adhesive curable by irradiation with ultraviolet light. The second adhesive forms the second adhesive layer 8 exhibiting elasticity even after having cured, and fixes the lead line 6 to the outer peripheral edge portion 15 with the lead line 6 being included in the second adhesive layer 8.

That is, in the shaping processing for the lead line 6 at the diaphragm 10 of the present embodiment, after the first adhesive layer 7 has been formed by curing of the first adhesive, the second adhesive layer 8 is formed by curing of the applied second adhesive. As a result, as illustrated in FIG. 4B, an end portion of the first adhesive layer 7 reaching the outer peripheral edge portion 15 from the valley portion 14 is covered with the second adhesive layer 8. Then, the terminal end of the lead line 6 is further drawn to the outside of the fixing portion 16 of the diaphragm 10, and is connected to the terminal 4 not shown in FIG. 4A upon assembly as the speaker unit 1.

Regarding the shaping processing for the lead line 6 of the voice coil 5, the first adhesive reaches, as described above, the valley portion 14 between two recessed ribs 13 in the first adhesive layer 7 for fixing the lead line 6, but does not reach three or more recessed ribs. Moreover, the second adhesive layer 8 for fixing the lead line 6 is formed in such a manner that the second adhesive is applied to the outer peripheral edge portion 15 on the outermost peripheral side close to the outermost fixing portion 16, a vibration amount being relatively small on the outermost peripheral side. Thus, influence on the strength and stiffness of the edge portion 12 is relatively small.

That is, the first adhesive layer 7 for fixing the lead line 6 at the edge portion 12 is formed only at one valley portion 14 as the minimum area, and the second adhesive layer 8 is formed at the less-influential outer peripheral edge portion 15. Thus, a difference in the strength and stiffness of the edge portion 12 of the diaphragm 10 in a circumferential direction from other portions of the edge portion 12 where no lead line 6 is fixed and no adhesive is applied can be reduced. As a result, the speaker unit 1 using the diaphragm 10 can improve vertical displacement symmetry and linearity of the edge portion 12 of the diaphragm 10, can reduce rolling of the vibration system or occurrence of noise, and can provide excellent reproduced sound quality.

Figure 5B:
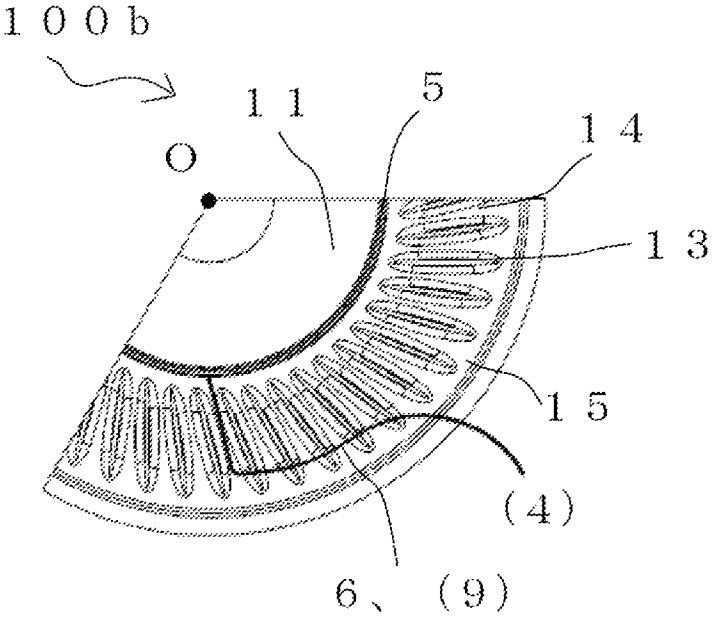
FIGS. 5A and 5B are views for describing shaping processing for lead lines of voice coils at diaphragms of comparison examples.
Figure 5A:
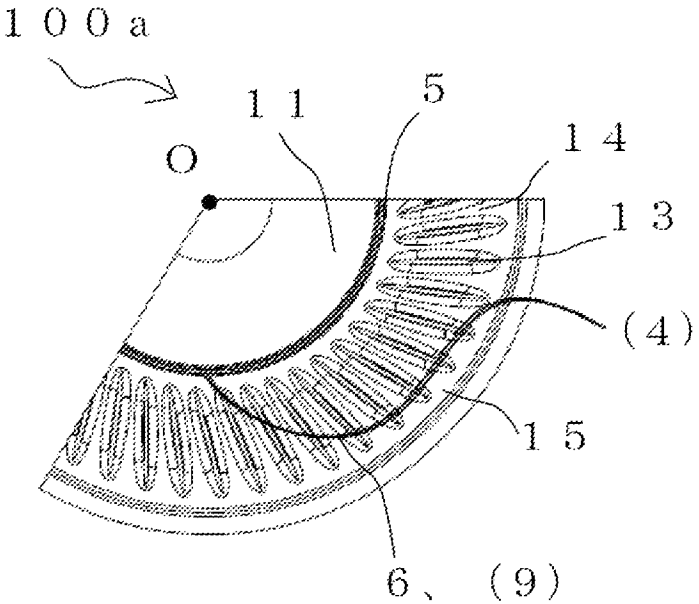

FIGS. 5A and 5B are views for describing the shaping processing for the lead lines 6 of the voice coils 5 at diaphragms 100*a*, 100*b* of comparative examples. Specifically, FIG. 5A is a view for describing a state in which part of the diaphragm 100*a* coupled to the voice coil 5 is viewed from the back side, and FIG. 5B is a view for describing a state in which part of another diaphragm 100*b* is viewed from the back side.

On the back side of the diaphragm 100*a*, 100*b*, the circular ring-shaped voice coil 5 is coupled to the voice coil attachment portion defined at the outer peripheral portion of the dome portion 11. Then, the lead line 6 connected to the voice coil 5 to supply the signal current is drawn to the outer peripheral side along the back side of the edge portion 12. A difference between the case of the diaphragm 10 of the present embodiment and the case of the diaphragm 100*a*, 100*b* of the comparative example is the shaping processing for the lead line 6 of the voice coil 5. Other configurations as the diaphragm and the speaker unit are common to those in the case of the above-described embodiment, and therefore, description of these common configurations will be omitted.

As in the case of the diaphragm 10 of the present embodiment, the lead line 6 of the voice coil 5 is fixed with an adhesive along the back side of the edge portion 12 of the diaphragm 100*a*, 100*b* of the comparative example, and the adhesive to be used is, as in a typical case, an ultraviolet cure adhesive curable by irradiation with one type of ultraviolet light. Note that description of the shaping processing for the lead line 6 is prioritized, and an adhesive layer 9 formed by curing of the adhesive is not shown in FIGS. 5A and 5B.

As illustrated in FIG. 5A, on the back side of the edge portion 12 of the diaphragm 100*a* of the comparative example, the lead line 6 of the voice coil 5 is arranged with the lead line 6 being curved toward the outer peripheral side over multiple (the total of eight spots) recessed ribs 13, and is directly fixed with the adhesive. The adhesive forms the (not-shown) adhesive layer 9 exhibiting elasticity even after having cured, and fixes the lead line 6 to the back side of the edge portion 12 with the lead line 6 being included in the adhesive layer 9 and extending over eight spots of the recessed ribs 13 and the valley portions 14. Thus, in the case of the diaphragm 100*a*, an area where the adhesive layer 9 is formed is larger than that in the case of the diaphragm 10 of the present embodiment, and the amount of adhesive entering the multiple valley portions 14 is also increased. For this reason, influence of the adhesive layer 9 on the strength and stiffness of the edge portion 12 is relatively great.

As illustrated in FIG. 5B, on the back side of the edge portion 12 of the diaphragm 100*b* of another comparative example, the lead line 6 of the voice coil 5 is first arranged to extend toward the outer peripheral side along the valley portion 14 defined between the certain recessed rib 13 and the adjacent recessed rib 13 thereof, is arranged with the lead line 6 being curved toward the outer peripheral side over multiple (the total of five spots) recessed ribs 13 in the middle of the valley portion 14, and is directly fixed with the adhesive. The adhesive forms the (not-shown) adhesive layer 9 exhibiting elasticity even after having cured, and fixes the lead line 6 to the back side of the edge portion 12 with the lead line 6 being included in the adhesive layer 9 and extending over five spots of the recessed ribs 13 and the valley portions 14. Thus, in the case of the diaphragm 100*b*, the area where the adhesive layer 9 is formed is larger than that in the case of the diaphragm 10 of the present embodiment, and the amount of adhesive entering the multiple valley portions 14 is also increased. For this reason, the influence of the adhesive layer 9 on the strength and stiffness of the edge portion 12 is relatively great.

That is, in the case of the diaphragm 100*a*, 100*b* of the comparative example, the adhesive layer 9 for fixing the lead line 6 at the edge portion 12 fixes the lead line 6 to the back side of the edge portion 12 over the multiple recessed ribs 13 and the multiple valley portions 14 across a relatively-large area. Thus, the difference in the strength and stiffness of the edge portion 12 in the circumferential direction from other portions of the edge portion 12 where no lead line 6 is fixed and no adhesive is applied becomes great. As a result, the speaker unit 1 using the diaphragm 100*a*, 100*b* of the comparative example degrades the vertical displacement symmetry and linearity of the edge portion 12, is difficult to reduce rolling of the vibration system or occurrence of noise, and degrades the reproduced sound quality.

Figure 6A:
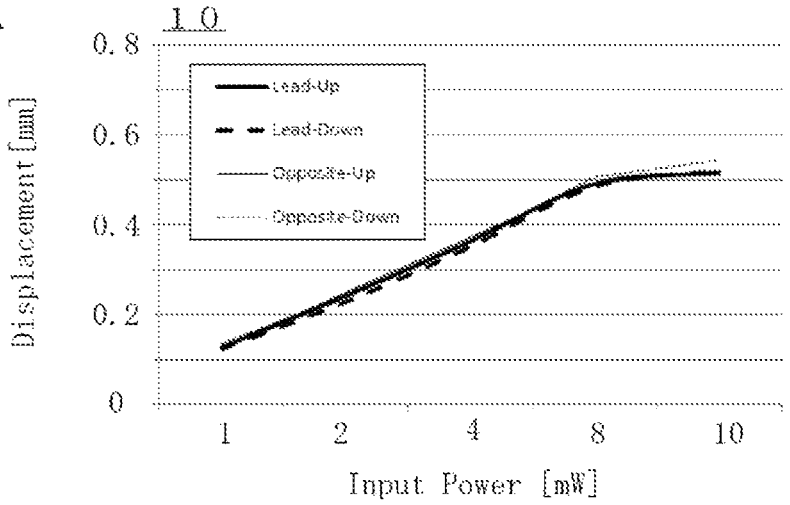
FIGS. 6A, 6B, and 6C are graphs of displacement symmetry and linearity of the diaphragms of the present embodiment and the comparison examples.
Figure 6B:
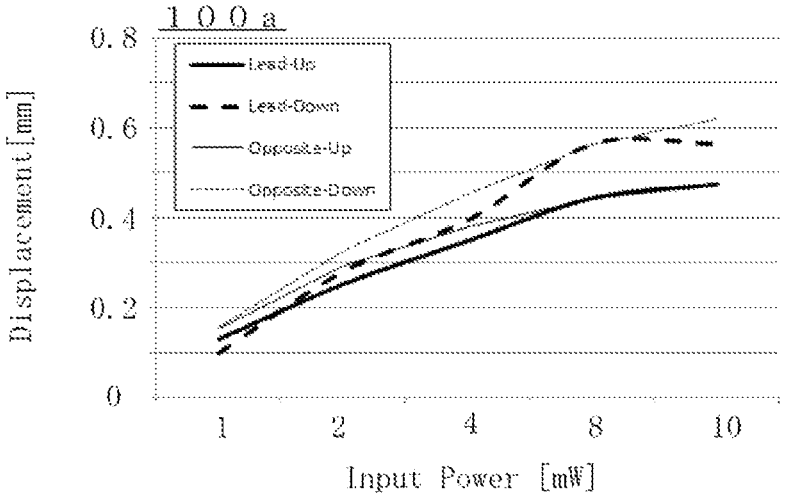
Figure 6C:
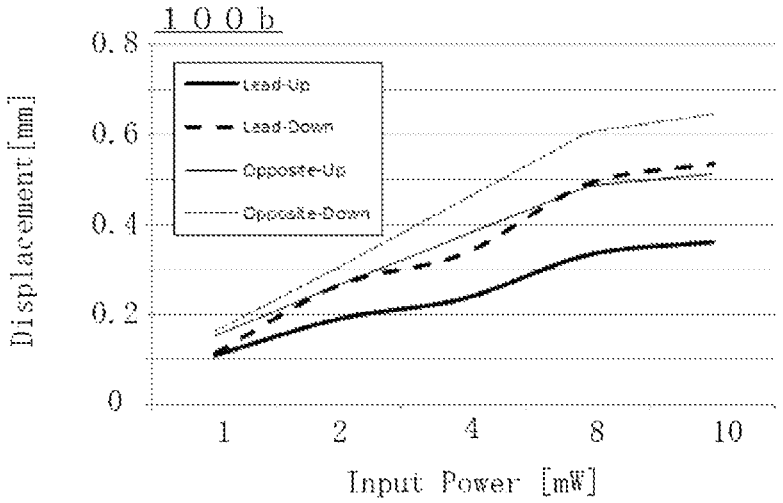

FIGS. 6A, 6B, and 6C are graphs of the displacement symmetry and linearity of the diaphragm 10 of the present embodiment and the diaphragms 100*a*, 100*b* of the comparative examples in the Z-axis direction. Each graph includes overwritten graphs for an upward direction (Up: a solid line, a forward direction) and a downward direction (Down: a dotted line, a backward direction), the horizontal axis being the value of input power [mW] when an input signal with a frequency (20 Hz) for increasing a minimum of displacement with a resonance frequency f0 or lower is provided to the speaker unit using each diaphragm and the vertical axis being the absolute value of the Z-axis displacement (Displacement [mm]) of the diaphragm 10 in response to the input power.

Considering the displacement symmetry of the edge portion 12 in the Z-axis direction, in the case of an ideal diaphragm exhibiting excellent displacement symmetry, a characteristic curve for the upward direction and a characteristic curve for the downward direction are, without a distance from each other, close to each other and are substantially coincident with each other. Considering the linearity, in the case of the diaphragm including the edge portion 12 exhibiting excellent linearity, the Z-axis displacement at the vertical axis preferably proportionately increases as the input power value at the horizontal axis increases at a constant rate in the order of 1 mW, 2 mW, 4 mW, and 8 mW.

Displacement measurement points at the diaphragm 10, 100*a*, 100*b* include two spots of a (Lead) portion in the vicinity of a portion of the lead line 6 of the voice coil 5 fixed with the adhesive and an (Opposite) portion in the vicinity of a rotationally-symmetric portion opposite to the (Lead) portion about the center point O, the lead line 6 being not fixed with the adhesive at the (Opposite) portion. With a small difference in the strength and stiffness of the edge portion 12 in the circumferential direction, characteristic curves for the (Lead) portion and the (Opposite) portion are not different from each other. On the other hand, when the difference in the strength and stiffness of the edge portion 12 in the circumferential direction is great, the characteristic curves for the (Lead) portion and the (Opposite) portion deviate from each other. In a case where the characteristic curves for the (Lead) portion and the (Opposite) portion deviate from each other, failure that noise occurs due to rolling of the diaphragm of the speaker unit might be caused.

With reference to the graphs of FIGS. 6A, 6B, and 6C, the case of the diaphragm 10 of the present embodiment (FIG. 6A) shows, as compared to the case of the diaphragm 100*a* of the comparative example (FIG. 6B) or the case of the diaphragm 100*b* of the comparative example (FIG. 6C), that the characteristic curves for the upward and downward directions are much close to each other, excellent Z-axis displacement symmetry and linearity of the edge portion 12 are exhibited, and there is almost no difference in the strength and stiffness of the edge portion 12 in the circumferential direction. That is, in the case of the diaphragm 10 of the present embodiment, the characteristic curves for the (Lead) portion and the (Opposite) portion are little different from each other.

On the other hand, in the case of the diaphragm 100*a* of the comparative example or the case of the diaphragm 100*b* of the comparative example, there is a marked difference in the strength and the stiffness between the (Lead) portion and the (Opposite) portion. It is obvious that the vertical displacement symmetry and the linearity are inferior as compared to the case of the diaphragm 10 of the present embodiment. Considering the vertical displacement symmetry, the case of the diaphragm 100*a* of the comparative example or the case of the diaphragm 100*b* of the comparative example shows more downward displacement and less upward displacement. A difference between the case of the diaphragm 10 of the present embodiment from the cases of the diaphragms 100*a*, 100*b* of the comparative examples is substantially only the shaping processing for the lead line 6 of the voice coil 5. Thus, it is shown that the shaping processing for the lead line 6 of the voice coil 5 of the diaphragm 10 of the present embodiment is superior as compared to the cases of the diaphragms 100*a*, 100*b* of the comparative examples.

Thus, the electrodynamic speaker unit 1 using the diaphragm 10 can reduce occurrence of noise due to rolling of the speaker vibration system including the voice coil and the diaphragm 10. With excellent Z-axis displacement symmetry of the diaphragm 10, the amount of air discharged from the diaphragm 10 in the case of an equal displacement absolute value between the upward direction and the downward direction approaches to a direction in which such an amount is equalized. Thus, occurrence of even-order distortion can be reduced, and excellent reproduced sound quality can be provided.

Figure 7A:
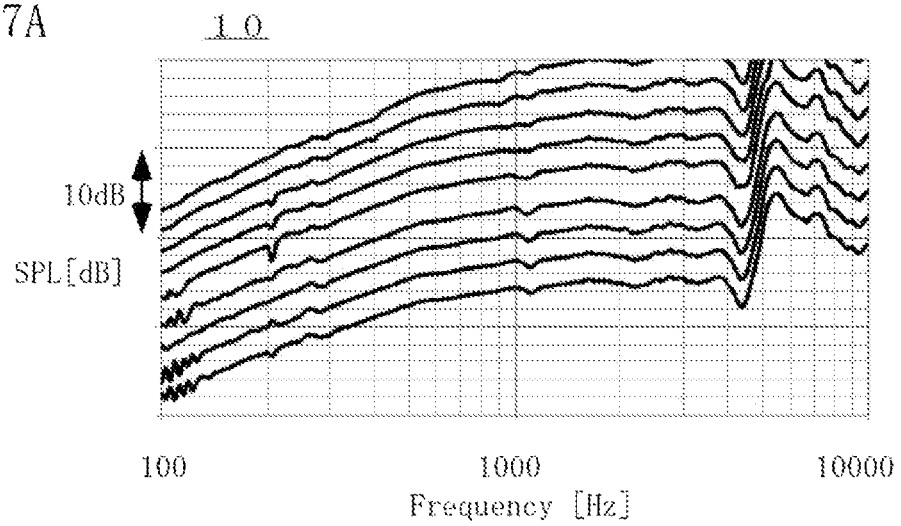
FIGS. 7A, 7B, and 7C are graphs of sound pressure frequency characteristics and linearity of electrodynamic speaker units using the diaphragms of the present embodiment and the comparison examples.
Figure 7B:
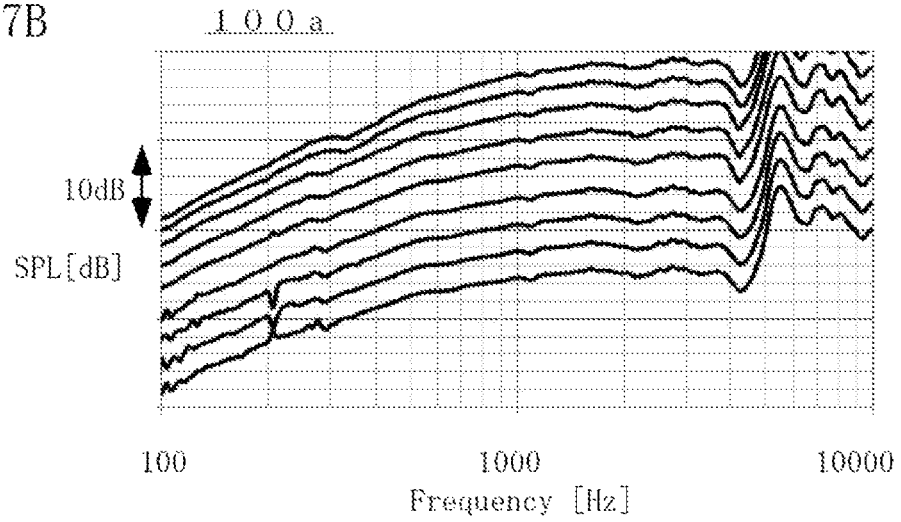
Figure 7C:
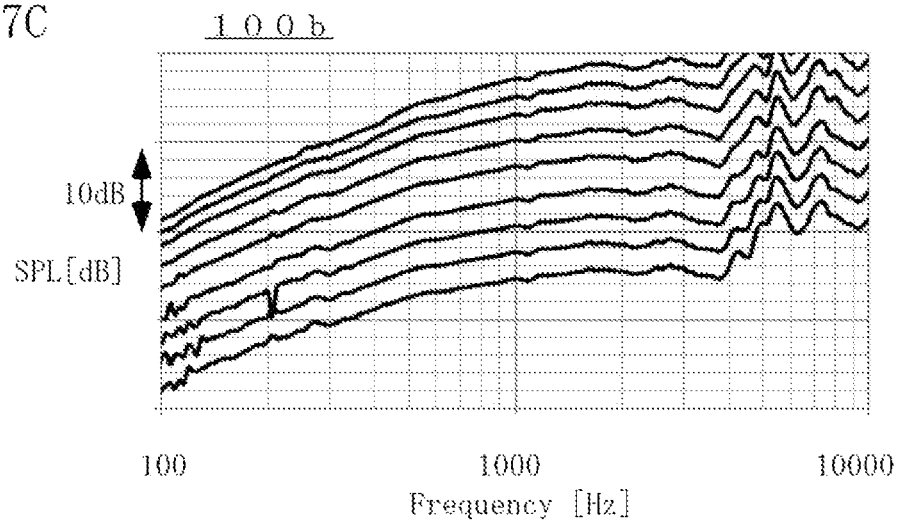

FIGS. 7A, 7B, and 7C are graphs of sound pressure frequency characteristics and linearity of the electrodynamic speaker units 1 using the diaphragm 10 of the present embodiment and the diaphragms 100*a*, 100*b* of the comparative examples. The horizontal axis is the frequency (100 Hz to 10 kHz) of an input audio signal, and the vertical axis is a sound pressure level of a sound wave to be reproduced at a position separated by a distance of about 3 cm. Note that the graphs measured while the value of the common input power [mW] is increased by twofold in the order of 1 mW, 2 mW, 4 mW, 8 mW, 16 mW, 32 mW, 64 mW, 128 mW, and 256 mW are overwritten. Thus, in an ideal case, it is expected that graphs separated from each other at equal intervals and increased in level by about 3 dB for all frequencies are shown.

The case of the diaphragm 10 of the present embodiment (FIG. 7A) shows the speaker unit exhibiting excellent linearity as described above. Thus, even when the input power changes from a smaller value to a greater value, the graphs separated at equal intervals and increased in level by about 3 dB for all frequencies are shown. The case of greatly changing the input power in the order of 32 mW, 64 mW, 128 mW, and 256 mW at around 100 Hz to 200 Hz with relatively-great Z-axis displacement of the diaphragm 10 needs to be focused.

On the other hand, the cases of the diaphragms 100*a*, 100*b* of the comparative examples (FIGS. 7B and 7C) not exhibiting excellent linearity show the speaker units exhibiting inferior linearity as compared to the case of the diaphragm 10 of the present embodiment. Thus, the level does not increase by about 3 dB specifically at a low frequency in the case of great input power, and therefore, graphs at non-equal intervals are shown. In the case of changing, at around 100 Hz to 200 Hz, the input power in the order of 32 mW, 64 mW, 128 mW, and 256 mW, a difference from the case of the diaphragm 10 of the present embodiment is prominently shown.

That is, in the case of the diaphragm 10 of the present embodiment, the linearity is improved even at a sound pressure level in reproduction as compared to the case of the diaphragm 100*a* of the comparison example and the case of the diaphragm 100*b* of the comparison example. The electrodynamic speaker unit 1 using the diaphragm 10 of the present embodiment can provide excellent reproduced sound quality of the headphone or the earphone including the speaker unit 1.

As a result of trial listening as compared to a (not-shown) headphone of the comparison example, it can be confirmed that in the case of the (not-shown) headphone including the electrodynamic speaker unit 1 using the diaphragm 10 of the present embodiment, excellent reproduced sound quality is provided as compared to the headphone of the comparison example. This is because in the case of the present embodiment, occurrence of an unnecessary sound wave such as noise due to rolling of the diaphragm 10 of the electrodynamic speaker unit 1 can be reduced. Needless to say, the electrodynamic speaker unit 1 using the diaphragm 10 may be used for a (not-shown) earphone configured such that a housing is directly supported on an ear of a user.

Note that the resin material forming the diaphragm 10 is not limited to the film-shaped PET member of the above-described embodiment. The material forming the diaphragm 10 may be, for example, films of other lightweight resin materials such as polyether ether ketone (PEEK), polyetherimide (PEI), polyethylene naphthalate (PEN), polycarbonate (PC), polyimide (PI), polyarylate (PAR), and polyphenylenesulfide (PPS) or a material formed by hot pressing of a sheet, or may be a material obtained by pressing of an elastomer sheet. Alternatively, the material forming the diaphragm 10 may be non-woven fabric formed of, e.g., natural fibers or synthetic fibers of cellulose or a paper material.

The diaphragm 10 can be taken as an assembly component of the speaker vibration system forming the electrodynamic speaker unit 1 configured such that the voice coil 5 is coupled to the voice coil attachment portion defined at the outer peripheral portion of the dome portion 11. For the lead line 6 of the voice coil 5, e.g., the shaping processing for the diaphragm 10 of the present embodiment may be performed. That is, the shaping processing may be performed, the shaping processing including the step of fixing the lead line 6 with the first adhesive forming the first adhesive layer 7 along the valley portion 14 defined between the certain recessed rib 13 and the adjacent recessed rib 13 thereof on the back side of the edge portion 12 and the step of further fixing the lead line 6 with the second adhesive forming the second adhesive layer 8 with the lead line 6 being curved along the outer peripheral edge portion 15.

In the present embodiment, the first adhesive forming the first adhesive layer 7 and the second adhesive forming the second adhesive layer 8 are the ultraviolet cure adhesives curable by irradiation with ultraviolet light, but other adhesives such as a rubber-based adhesive, an acrylic-based adhesive, and an epoxy-based adhesive may be used. Different adhesives may be used as the first adhesive and the second adhesive. The first adhesive is preferably an adhesive of which curing time is short, but a proper adhesive can be selected as long as curing time for curing the first adhesive to form the first adhesive layer 7 is ensured after the step of fixing the lead line 6 with the first adhesive. The lead line 6 can be shaped to curve along the outer peripheral edge portion 15 before the lead line 6 is fixed with the second adhesive.

Note that according to the diameter dimension of the voice coil 5 and the thickness dimension of the resin material forming the diaphragm 10, the shape dimensions of the dome portion 11 and the edge portion 12 are changeable, including the dimensions of the curved surface formed by chamfering of the ridge line portion of the recessed rib 13. Moreover, the dome portion 11 of the diaphragm 10 of the present embodiment may be in the above-described shape such as part of the spherical surface, but a rib as a recessed or raised groove for reinforcement may be also provided at the dome portion 11.

The frame 2 of the present embodiment employs the above-described resin material containing, at the specific ratio, the polyphenylene ether-based resin, the polystyrene-based resin, and the polyolefin-based resin, and therefore, the lightweight frame 2 having favorable balance among a high internal loss and excellent mechanical characteristics, excellent heat resistance, and an excellent S/N ratio can be obtained. However, the frame 2 may be made of other resin materials different in the ratio or a metal material.

The diaphragm of the present invention is not limited to the illustrated electrodynamic speaker unit, and may be a speaker unit further including a damper to form a speaker vibration system. The present invention is not limited to the electrodynamic speaker unit, and is also applicable to a piezoelectric speaker unit.

What is claimed is:

1. A diaphragm comprising:

a voice coil forming an electrodynamic speaker unit used for a headphone or an earphone, wherein the diaphragm is formed from a sheet-shaped member or a film-shaped member such that a center dome portion and an edge portion extending at an outer periphery of the dome portion and having a raised section in a radial direction are integrated, the edge portion is configured such that multiple recessed ribs formed by recessing of a raised surface are provided in an inclination direction inclined with respect to a radial line passing through a center point and are arranged rotationally symmetrically, and among the recessed ribs and a fixing portion defined on an outermost peripheral side of the diaphragm, defines an outer peripheral edge portion at which no recessed ribs are formed, and the voice coil is coupled to a voice coil attachment portion defined at an outer peripheral portion of the dome portion, and a lead line configured to supply signal current to the voice coil is fixed with a first adhesive forming a first adhesive layer along a portion defined between one of the recessed ribs and an adjacent one of the recessed ribs on a back side of the edge portion, and is further fixed with a second adhesive forming a second adhesive layer with the lead line being curved along the outer peripheral edge portion.

2. The diaphragm according to claim 1, wherein the second adhesive layer is formed by curing of the applied second adhesive at least after the first adhesive layer has been formed by curing of the first adhesive.

3. The diaphragm according to claim 1, wherein an end portion of the first adhesive layer reaching the outer peripheral edge portion is covered with the second adhesive layer.

4. The diaphragm according to claim 1, wherein the first adhesive and the second adhesive are both ultraviolet cure adhesives.

5. A speaker unit comprising:

the diaphragm according to claim 1;

a frame fixed to the fixing portion of the edge portion of the diaphragm;

a terminal fixed to the frame and connected to the lead line of the voice coil;

a magnetic circuit having a magnetic gap in which a coil of the voice coil is arranged and fixed to the frame; and a damping member attached to cover an opening of the frame.

6. A headphone or an earphone comprising:

the speaker unit according to claim 5.

7. A method for manufacturing a diaphragm including a voice coil forming an electrodynamic speaker unit used for a headphone or an earphone, comprising:

a step of integrally forming, from a sheet-shaped member or a film-shaped member, a center dome portion of the diaphragm and an edge portion extending at an outer periphery of the dome portion and having a raised section in a radial direction, providing, at the edge portion, multiple recessed ribs formed by recessing of a raised surface in an inclination direction inclined with respect to a radial line passing through a center point and rotationally symmetrically arranging the recessed ribs, and defining, among the recessed ribs and a fixing portion defined on an outermost peripheral side of the diaphragm, an outer peripheral edge portion at which no recessed ribs are formed;

a step of coupling the voice coil to a voice coil attachment portion defined at an outer peripheral portion of the dome portion;

a step of fixing a lead line configured to supply signal current to the voice coil with a first adhesive forming a first adhesive layer along a portion defined between one of the recessed ribs and an adjacent one of the recessed ribs on a back side of the edge portion; and a step of further fixing the lead line with a second adhesive forming a second adhesive layer with the lead line being curved along the outer peripheral edge portion.

* * * * *